United States Patent [19]

Ferro et al.

[11] Patent Number: 4,500,116

[45] Date of Patent: Feb. 19, 1985

[54] IDENTIFICATION MATTER

[75] Inventors: Berkeley M. Ferro, Barnehurst; Aubrey D. Walker, North Harrow, both of England

[73] Assignee: The Post Office, London, England

[21] Appl. No.: 168,151

[22] Filed: Jul. 14, 1980

Related U.S. Application Data

[63] Continuation of Ser. No. 4,054, Jan. 16, 1979, abandoned.

[30] Foreign Application Priority Data

Jan. 18, 1978 [GB] United Kingdom ..... 2096/78

[51] Int. Cl.[3] ..... B42D 15/00

[52] U.S. Cl. ..... 283/92; 235/491; 283/904; 283/75; 283/109; 283/94; 428/916; 428/913; 430/10

[58] Field of Search ..... 428/916, 913; 430/10; 235/491; 283/7, 8, 74, 75, 89, 92, 94, 109, 904; 40/2 R

[56] References Cited

U.S. PATENT DOCUMENTS

| | | | |
|---|---|---|---|
| 3,279,826 | 10/1966 | Rudershausen | 40/2.2 |
| 3,533,176 | 10/1970 | Weitzburg | 40/2.2 |
| 3,610,120 | 10/1971 | Morse et al. | 430/10 |
| 3,679,448 | 7/1972 | Tramposch | 283/8 R X |
| 3,754,959 | 8/1973 | Peters | 427/146 |
| 3,763,356 | 10/1973 | Berler | 235/468 |
| 3,800,142 | 3/1974 | Harshaw | 250/363 |
| 3,928,226 | 12/1975 | McDonough | 428/916 X |
| 4,151,667 | 5/1979 | Idelson | 283/7 X |

FOREIGN PATENT DOCUMENTS

| | | |
|---|---|---|
| 2101714 | 3/1972 | France . |
| 2289976 | 10/1975 | France . |
| 870504 | 6/1961 | United Kingdom . |
| 1466102 | 3/1977 | United Kingdom . |
| 1494102 | 12/1977 | United Kingdom . |
| 1494103 | 12/1977 | United Kingdom . |

OTHER PUBLICATIONS

Great Britian, No. 1123274, Virginia Laminating Company.

*Primary Examiner*—Paul A. Bell

*Attorney, Agent, or Firm*—Mason, Fenwick & Lawrence

[57] ABSTRACT

A credential, such as a passport or an identification card, is provided, for example by impregnation or coating, with a phosphorescent composition which includes at least two phosphorescence activators which exhibit different emission characteristics both with respect to wavelength and lifetime so that, when the composition is irradiated, the initial afterglow changes color, for example from green to blue.

7 Claims, 3 Drawing Figures

IDENTIFICATION MATTER

Figure 1:
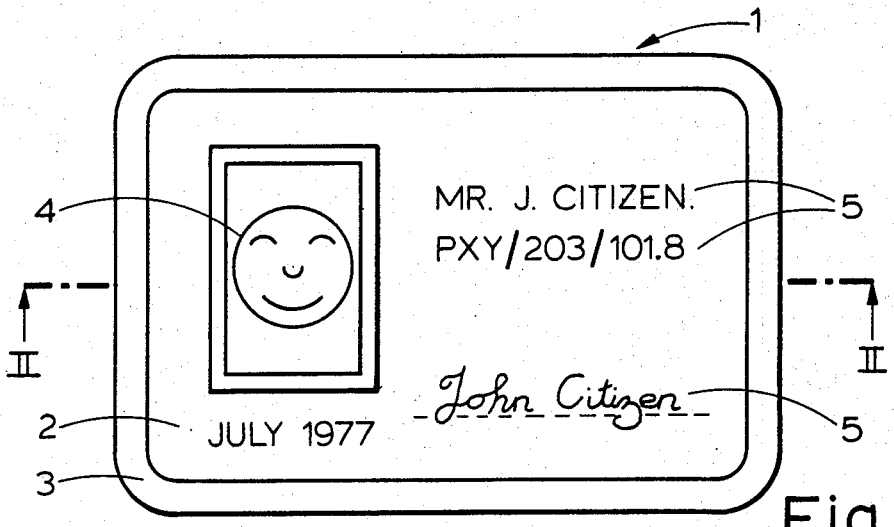

This is a continuation of application Ser. No. 4,054, filed Jan. 16, 1979.

The present invention relates to an article for establishing identity, and more especially concerns a credential, that is to say, an article the purpose of which, inter alia, is to establish the identity of the person presenting it.

Credentials of various kinds are in extensive use today, for example, in the fields of national and international security (e.g. passports, security passes and identification cards) and, increasingly, in the world of finance (e.g. credit cards, bank service cards, cash cards and cheque guarantee cards). It is essential that the person to whom the credential is presented can be reasonably certain that he is not being offered a forged or tampered-with article, and it is important that he can check rapidly and reliably on its authenticity.

U.S. Pat. No. 3,279,826 discloses an identification card consisting of an inner core carrying identification information and protected by laminated-on transparent film. Part or all of the core is coated with a fluorescent material and a pattern of some kind is printed on the fluorescent region using an invisible ink opaque to ultraviolet light (ultraviolet screening agent). When the identification card is viewed under ultraviolet light, the pattern appears dark against a luminescent background; it is not, of course, visible at all in normal light. An official to whom the card is presented can check quickly and simply for the presence of the pattern by means of a ultraviolet lamp.

It has been found, however, that it is possible for a forger to reproduce this effect given the large number of fluorescent compounds and ultraviolet screening agents available and the ease with which an effective fluorescent coating can be prepared.

Accordingly, there is a need for a credential which is more difficult to reproduce illegally but which can still be tested using ultraviolet light.

The present invention provides an article for establishing identity, comprising a substrate carrying identification markings, at least part of the article having thereon or therein phosphorescent material including more than one phosphorescence activator (as hereinafter defined), the emissions of the activators differing from one another with respect to both wavelength and lifetime.

The term "phosphorescence activator" is used to describe an organic compound the energy levels of which are such that under suitable conditions it will phosphoresce during and after irradiation with ultraviolet light. The phosphorescence represents the radiative decay of a triplet excited state to the singlet ground state; this transition is forbidden and the triplet state has a relatively long lifetime, so that afterglow occurs. This may be contrasted with fluorescence (the radiative decay of an excited singlet state) which ceases as soon as the exciting light source is removed or switched off. For a molecule in an excited triplet state, collision-induced non-radiative decay pathways are more favourable and will always predominate under conditions in which molecular interaction is possible, for example, in the liquid phase. To obtain observable phosphorescence it is necessary to prevent non-radiative decay as far as possible by isolating the molecules from one another in a rigid matrix. The matrix itself must, of course, be transparent to radiation at the excitation and emission frequencies of the phosphorescence activator. The phosphorescence lifetime (duration of afterglow) of a particular activator will depend on the environment of the molecules and thus on the chemical nature of the matrix.

The phosphorescent material used in the identification article of the invention contains more than one activator, and advantageously contains two. Two activators are preferably chosen that have emissions differing substantially with respect to both wavelength (colour) and lifetime. After irradiation of a material containing two such activators, a combined emission from both activators will initially be observed, and subsequently only the emission from the longer-lived activator will be seen. The afterglow will thus appear to change colour with time.

This effect is very distinctive, and provides a safeguard against forgery. Nothing comparable can be produced using fluorescent materials.

According to a preferred embodiment of the invention, the phosphorescent material present in or on the identification article of the invention utilises a cross-linked condensation resin as a matrix. The resin-forming condensation reaction is carried out in the presence of the phosphorescence activators so that the activator molecules are trapped and isolated from one another in the matrix. The phosphorescent material is preferably of the type described in our British Patent Specification No. 870 504, that is to say, one component of the condensation resin is formaldehyde and the other is preferably an amino compound, more preferably urea or melamine. The phosphorescent material on the article of the invention may, if desired, have been produced in situ by condensation of a soluble precondensate of the resin in the presence of the phosphorescence activators, preferably as described and claimed in British Patent Specifications Nos. 1 494 102 and 1 494 103, the disclosures of which are incorporated herein by reference.

Alternatively, the phosphor may be produced in the form of a fully condensed resin, as described in British Patent Specification No. 870 504, the disclosure of which is incorporated herein by reference, before application to the credential by printing or coating.

The article of the invention may be of any suitable form, ranging, for example, from a simple piece of plastics material, for example, a credit card, to a booklet, for example, a passport. It may, for example, be externally printed or coated with the phosphorescent material; a porous material such as paper may be impregnated with the phosphorescent material. Paper or card suitable for use in the article of the invention may be produced from stock containing the phosphorescent material and the term "impregnation" as used herein is to be understood as including this method of introducing the phosphor into paper or card.

The coated, printed or impregnated part of the article may be surrounded or covered by another material; the covering material must, however, be sufficiently transparent at the appropriate frequencies that excitation of the phosphorescence activators is possible and the emitted light is clearly visible when irradiated and viewed through the covering material.

In one known form of credential, a core made, for example, of cardboard, paper or opaque or translucent plastics material is surrounded or covered by at least one layer of transparent plastics material, for example, polyester and/or polyethylene. Identification information is generally carried by the core, which may be physically bonded to the plastics material to form a sandwich-type structure, or, alternatively, may be sealed into an envelope of the plastics material.

According to one embodiment of the present invention, a credential of the general type just described has printed matter, for example, indicia or a design, in phosphorescent ink printed either on the core itself or on either the inner or outer surface of the surrounding plastics material, preferably on the inner surface. Some or all of the identification information itself may be printed in phosphorescent ink; alternatively, visible ink, embossing or other visible means may be used for that information and an additional design or other printed matter in phosphorescent ink may also be present. If the phosphorescent printing is on the core or on the inner surface of the plastics material, the latter must of course satisfy the transparency condition mentioned above.

As already indicated, the phosphorescent ink used may, for example, be of the particulate type described in British Patent Specification No. 870 504 or of the aqueous solution type described and claimed in British Patent Specification No. 1 494 102, the former type being preferred, especially if the substrate to be printed on is plastics material. Such ink generally consists of a suspension of the finely ground phosphor and a suitable binder in a volatile organic solvent, for example, toluene. The gravure method of printing is especially preferred, and the components of the ink may be those normally used for gravure inks, the phosphorescent pigment replacing the visible pigment normally used.

Advantageously the ink base is a solvent in which the plastics material of the credential is soluble; more advantageously, the ink is so formulated that it is dispersible, that is to say, it will be smudged, by any solvent in which the plastics material is soluble, so that any attempt to dissolve away the outer covering of plastics material in order to tamper with the identification information inside will result in destruction of the phosphorescent legend.

It is especially preferred, according to the invention, to use a plastics outer covering consisting of a laminate of polyester and polyethylene with the polyethylene layer on the inside, and to print a phosphorescent legend or design onto the polyethylene layer. In this case, the phosphorescent printing ink is advantageously formulated using binding media, for example, film-forming resins, that will render it to some extent thermoplastic, so that as the plastics substrate passes between the heated print rollers, the low-melting point polyethylene flows to a certain extent and bonds to the core, which is preferably paper, and the ink flows with the polyethylene and is bonded to the core.

In an alternative embodiment of the invention relating to the same general type of credential, the core, preferably of paper or card, may be coated or impregnated with a composition containing the phosphorescent material, or, as previously indicated, the paper or card core may be manufactured from phosphor-containing stock.

A paper-coating composition suitable for use in this embodiment of the invention is described and claimed in British Patent Specification No. 1 494 102, and a method for its application to paper is described and claimed in British Patent Specification No. 1 494 103. The coating composition contains the phosphorescence activators and a soluble precondensate of the condensation resin, and the condensation resin matrix is formed in situ on the paper around the activator molecules.

Some examples of phosphorescence activators suitable for use in the present invention are listed below, giving the colour of the afterglow and its relative duration when a urea-formaldehyde resin matrix is used:

| Activator | Colour | Duration |
|---|---|---|
| (a) Terephthalic acid | blue/violet | short |
| (b) Sulphanilic acid | blue/violet | medium |
| (c) Carbazole sulphonic acid | blue | long |
| (d) p-Aminobenzoic acid | violet | medium |
| (e) p-Aminobenzophenone | green | short |
| (f) p-Hydroxydiphenyl | blue/green | long |
| (g) Fluorene sulphonic acid | green | long |
| (h) Diphenylene oxide sulphonic acid | blue | long |
| (i) 1-Naphthylamine 2-sulphonic acid | yellow | medium |
| (j) 1-Naphthylamine 8-sulphonic acid | lime-green | long |
| (k) 2-Naphthylamine 5,7-disulphonic acid | yellow | long |
| (l) α-Naphthoflavone | green | long |

Some of these organic phosphorescence activators, for example, terephthalic acid, sulphanilic acid and p-aminobenzoic acid, are only activated by short-wavelength (254 nm) ultraviolet light and are unaffected by long-wavelength (365 nm) radiation; most of them, however, are activated to some extent by light of both wavelengths.

According to the invention, a suitably matched combination of two or more activators is used. Examples of suitable activator pairs include the following:

(i) p-Aminobenzophenone/carbazole sulphonic acid (green to blue)
(ii) Terephthalic acid/2-naphthylamine-5,7-disulphonic acid (blue to yellow)
(iii) Sulphanilic acid/1-naphthoflavone (blue to green)
(iv) p-Aminobenzophenone/2-naphthylamine-5,7-disulphonic acid (blue green to yellow)
(v) p-Aminobenzophenone/diphenylene oxide sulphonic acid (blue/green to blue)

Combinations (ii) and (iii) show a colour change only in conjunction with shortwave (254 nm) irradiation because the first activator of each pair is not responsive to 365 nm light. If light of the longer wavelength is used, the colour of the second activator alone is seen. These systems thus provide an additional safeguard against forgery in that they respond differently to 365 nm and 254 nm light.

The combinations (i), (iv) and (v) show the stated colour change whether long or short-wave UV is used. The combination (i) shows the most visually apparent colour change.

Although for the sake of convenience the article of the invention has been referred to in the foregoing as a credential, it will be appreciated that the scope of the invention is not limited to credentials and that the invention encompasses any article that may be used to establish the identity of, for example, a person, object, or animal.

Figure 2:
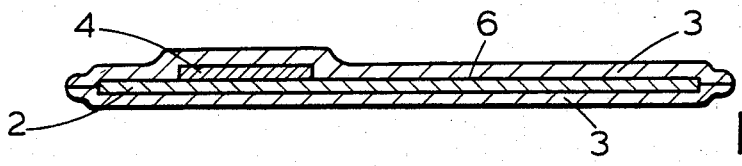
Figure 3:
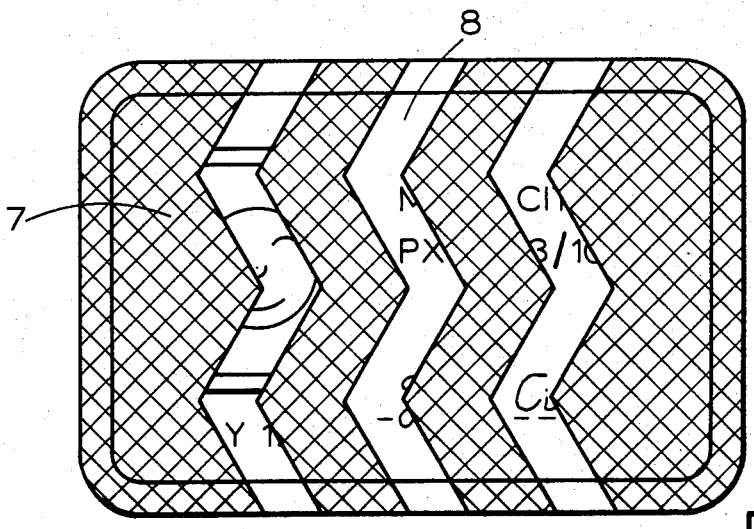

A credential according to the invention will now be described in greater detail, by way of example only, with reference to the accompanying drawings, in which:

FIG. 1 represents, in plan view, an identification card of the invention as it appears under normal light, FIG. 2 is a cross-section along the line II—II of FIG. 1, and FIG. 3 represents the card of FIG. 1 as it would appear in subdued ambient light subsequent to ultraviolet irradiation.

Referring now to FIGS. 1 and 2 of the drawings, an identification card generally indicated by the reference numeral 1 consists of a core 2, consiting for example of paper, surrounded by laminated-on transparent plastics film 3, for example, polyester with an inner layer of polyethylene. The core 2 carries identification information, for example, an affixed photograph 4 and embossed, printed or written indicia 5. The inner side 6 of the plastics film has been printed with a pattern using a two-tone phosphorescent ink containing the activator pair (i) mentioned above.

FIG. 3 shows the card which has been exposed briefly to 365 nm ultraviolet light, and is now being viewed in subdued ambient light so that the untreated parts 7 of the card appear dark. A luminescent pattern 8 is now visible; for the sake of clarity a very simple pattern has been shown. The pattern initially appears green and changes over a few seconds to blue.

The following Examples illustrate the invention.

EXAMPLE 1

Preparation and use of a particulate phosphorescent printing ink

Urea (5 kg) is melted and heated until it boils gently. 100 g of p-aminobenzophenone and 75 g of the sodium salt of carbazole sulphonic acid are added and heating is continued until the molten urea begins to be turbid. During the heating stage, decomposition of the urea into various products, chiefly cyanuric acid, occurs; the onset of turbitidity indicates that the solubility of cyanuric acid in urea has been exceeded, and the heating is discontinued at this point.

Paraformaldehyde (1950 g) is added gradually to the reaction mixture with continuous stirring, slight heat being applied when necessary to keep the mixture molten. The fully mixed product is heat-cured at 150° C. for 2 to 4 hours, allowed to cool and then ground to fine powder.

This ink may be used successfully for gravure printing on a polyester/polyethylene laminate. After irradiation with 365 nm UV light, the printed areas display a green afterglow changing in a few seconds to blue.

EXAMPLE 2

Preparation and use of an aqueous solution phosphorescent printing ink 850 g of melamine (1.3 moles) are mixed with 400 g of 37% aqueous formaldehyde (1 mole), the suspension is stirred, and 300 ml buffer solution (sodium carbonate/-sodium borate pH 9.2) added to give a pH of about 9. 17 g of p-aminobenzophenone in methanol solution and 13 g of carbazole sulphonic acid sodium salt are then added and sufficient water is added to give a total liquid volume of about 2.5 liters. The suspension is stirred and heated to reflux, and this temperature is maintained for 50 to 60 minutes. The heat source is removed and about 300 ml of methanol are added. Stirring is continued until the mixture has cooled. It is then allowed to stand at room temperature for about 18 hours. The liquid is then decanted; this yields about 2.5 liters of ink.

The recovered solid (350 g) may be washed with 50/50 ethanol/water, dried and re-used as follows: 350 g of recovered solid is mixed with 450 g of fresh melamine; 300 ml of a buffer of pH 9.2 and 350 g of 37% aqueous formaldehyde solution are then added. After addition of the carbazole sulphonic acid sodium salt, p-aminobenzophenone and water, the preparation is carried out as described above. A further yield of about 2.5 liters of ink may be obtained.

The aqueous ink has a low viscosity and contains about 20% by weight of a fairly low molecular weight melamine-formaldehyde precondensate. About 10 to 15% by volume of ethanol may be added as stabiliser, and the solution may be stored for 6 months without significant increase in viscosity.

This ink may be used successfully for gravure printing on a polyester/polyethylene laminate which may then be incorporated into a credential according to the present invention. After irradiation with 365 nm UV light, the printed areas display a green afterglow changing in a few seconds to blue.

In an alternative method of preparing the ink described above, two single-activator inks may be separately prepared and then mixed together. Each ink is produced using the methods and amounts described in the preceding paragraphs, one ink containing 13 g of carbazole sulphonic acid sodium salt as activator and the other containing 17 g of p-aminobenzophenone.

EXAMPLE 3

Preparation and use of a paper-coating mix

In an alternative embodiment of the invention, as previously mentioned, the credential may have a core of paper or card coated with a phosphorescent composition. This Example describes the preparation of a suitable coating composition.

24 g of p-aminobenzophenone in methanol solution and 18 g of carbazole sulphonic acid are added to 1.8 liters of 40% aqueous formaldehyde neutralised with sodium hydroxide solution. The mixture is heated to 75° C. and the pH adjusted to 8 by the addition of further alkali. 1.2 kg of melamine powder is added and the temperature of the mix is maintained at 75° C. with efficient stirring. The melamine dissolved to give a clear yellow solution after 10 to 15 minutes. The pH is maintained at 8.

Half an hour after the addition of the melamine, a sample is withdrawn from the solution and titrated with water until the mixture becomes turbid. Samples are taken at 10 to 15 minute intervals. As the reaction proceeds, the quantity of water required to precipitate solid resin from the solution decreases and the viscosity of the activator-precondensate solution increases. When the reaction has proceeded to a point at which 2.5 to 3 volumes of water are sufficient to produce turbidity in 1 volume of solution, the solution is mixed with a conventional aqueous coating mix consisting of pigment and binder, with constant stirring, in such an amount that the resulting wet coating mix contains about 20% by weight of activator/precondensate solution.

If desired, the activator/precondensate solution may be prepared by a slightly different procedure in which the carbazole sulphonic acid is neutralised by calcium carbonate instead of sodium hydroxide and the pH is maintained at 6.2 throughout the reaction. As the reaction mixture is always turbid, the progress of the reaction is monitored by measuring the viscosity of the solution, the end-point being taken to be when the solution has a viscosity of 10 to 12 cp.

The coating mix is applied immediately after preparation, by any suitable method, to paper or card. Curing of the melamine-formaldehyde resin then takes place on the surface of the paper or card. To accelerate curing, an acidic curing agent, for example, dilute sulphuric acid, may be added to the activator/precondensate solution immediately before mixing with the other components (pigment, binder etc) of the coating mix.

The coated paper or card, on irradiation with 365 nm UV light, exhibits a green afterglow changing in a few seconds to blue.

What is claimed is:

1. An article for establishing personal identity, comprising a substrate carrying identification markings, said substrate having thereon or therein a phosphorescent material comprising a rigid matrix in which there are dispersed two or more organic phosphorescense activators which are unresponsive to visible light and which during and after irradiation with ultraviolet light emit visible phosphorescense, said matrix being transparent to radiation at the excitation and emission frequencies of said phosphorescense activators, said emissions of said phosphorescense activators differing from one another with respect to both wavelengths and lifetime, whereby the total emission of said phosphorescent material after cessation of said irradiation changes from an initial colour representing the combined emissions of said activators to a final colour representing the emission of that activator having the longest phosphorescence lifetime.

2. An article as claimed in claim 1, wherein the phosphorescent material contains two phosphorescence activators.

3. An article as claimed in claim 2, wherein the phosphorescent material contains, as activators, carbazole sulphonic acid or a salt thereof and p-aminobenzophenone.

4. An article as claimed in claim 1, wherein the phosphorescent material comprises a cross-linked condensation resin prepared by a condensation reaction in the presence of the phosphorescence activators.

5. An article as claimed in claim 4, wherein the cross-linked resin is a condensation resin selected from the group consisting of urea formaldehyde resins and melamine-formaldehyde resins.

6. An article as claimed in claim 1, wherein the substrate comprises:

(a) a core of paper, board or plastics material, said core bearing said identification markings and (b) an outer covering comprising at least one layer of transparent plastics material, said outer covering having at least one inner surface adjacent said core, said phosphorescent material being present in the form of printed matter on at least one of said core and said inner surface.

7. An article as claimed in claim 1, wherein the substrate comprises:

(a) a core of paper or board, said core bearing said identification markings, and (b) an outer covering comprising at least one layer of transparent plastics material, said phosphorescent material being coated onto said core or distributed througout said core.

* * * * *